US008054284B2

(12) United States Patent
Tai et al.

(10) Patent No.: US 8,054,284 B2
(45) Date of Patent: Nov. 8, 2011

(54) BACK LIGHT MODULE AND DRIVING METHOD THEREOF

(75) Inventors: Wen-Chih Tai, Taoyuan County (TW); Tzu-Chiang Shen, Tao-Yuan Hsien (TW); Chia-Lin Liu, Tai-Chung Hsien (TW); Chi-Neng Mo, Tao-Yuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 830 days.

(21) Appl. No.: 11/963,878

(22) Filed: Dec. 24, 2007

(65) Prior Publication Data

US 2008/0165118 A1 Jul. 10, 2008

(30) Foreign Application Priority Data

Jan. 10, 2007 (TW) ..... 96100933 A

(51) Int. Cl.
*G09G 3/36* (2006.01)

(52) U.S. Cl. ..... 345/102; 345/82; 345/204; 345/214; 345/690; 345/77; 315/169.3; 362/555; 362/561

(58) Field of Classification Search ..... 345/102, 345/76, 77, 82, 93, 204, 214, 690; 315/169.3; 362/555, 561
See application file for complete search history.

(56) References Cited

U.S. PATENT DOCUMENTS

| | | | | |
|---|---|---|---|---|
| 5,886,474 | A * | 3/1999 | Asai | 315/169.1 |
| 6,084,561 | A * | 7/2000 | Kudo et al. | 345/89 |
| 7,839,413 | B2 * | 11/2010 | Liao | 345/581 |
| 2005/0184952 | A1 * | 8/2005 | Konno et al. | 345/102 |
| 2006/0139954 | A1 * | 6/2006 | Kobori et al. | 362/613 |
| 2007/0052662 | A1 * | 3/2007 | Kim et al. | 345/102 |

FOREIGN PATENT DOCUMENTS

CN 201007903 Y 1/2008

* cited by examiner

*Primary Examiner* — Lun-Yi Lao
*Assistant Examiner* — Sosina Abebe
(74) *Attorney, Agent, or Firm* — Winston Hsu; Scott Margo

(57) ABSTRACT

A back light module and a method for driving the back light module are disclosed. The back light module includes a plurality of light emitting units and a driving unit. The driving unit is electrically connected to the light emitting units and utilized for driving the light emitting units according to a switched-on number of the light emitting units and a dithering scheme.

6 Claims, 8 Drawing Sheets

| | | | |
|---|---|---|---|
| L0 | L8 | L2 | L10 |
| L12 | L4 | L14 | L6 |
| L3 | L11 | L1 | L9 |
| L15 | L7 | L13 | L5 |

Fig. 7

| | | | | | | | |
|---|---|---|---|---|---|---|---|
| L00 | L32 | L08 | L40 | L02 | L34 | L10 | L42 |
| L48 | L16 | L56 | L24 | L50 | L18 | L58 | L26 |
| L12 | L44 | L04 | L36 | L14 | L46 | L06 | L38 |
| L60 | L28 | L52 | L20 | L62 | L30 | L54 | L22 |
| L03 | L35 | L11 | L43 | L01 | L33 | L09 | L41 |
| L51 | L19 | L59 | L27 | L49 | L17 | L57 | L25 |
| L15 | L47 | L07 | L39 | L13 | L45 | L05 | L37 |
| L63 | L31 | L55 | L23 | L61 | L29 | L53 | L21 |

Fig. 8

BACK LIGHT MODULE AND DRIVING METHOD THEREOF

BACKGROUND OF THE INVENTION

1. Field of the Invention

The present invention relates to a technology for controlling a light emitting unit, and more particularly, to a back light module utilizing a dithering scheme to drive a plurality of light emitting units, and a related driving method.

2. Description of the Prior Art

Light emitting diodes (LEDs) used as light sources have become popular in recent years. For example, the light source in a back light module of a conventional liquid crystal display (LCD) panel is usually a plurality of cold cathode fluorescent lamps (CCFLs). However, as the luminous efficiency of an LED increases and the cost of LEDs decreases, CCFLs are gradually being replaced by LEDs as the light source in a back light unit.

The LED back light module is implemented with a driving scheme of controlling divided areas. In other words, the LCD panel and the LED back light are divided into a plurality of areas, wherein each area of the LCD panel corresponds to each area of the LED back light unit. Please refer to FIG. 1. FIG. 1 is a diagram of a conventional back light module 100 of an LCD. As shown in FIG. 1, the back light module 100 includes a plurality of LEDs 110, a timing controller 120, a pulse width modulation (PWM) controller 130, and a plurality of switches 140. The timing controller 120 outputs a control signal SC according to the peak values of the gray levels in different areas of the LCD panel. The PWM controller 130 is electrically connected to the timing controller 120 and utilized for controlling an on/off state of the switches 140 according to the control signal $S_c$ in order to adjust the luminance of each area of the LEDs 110.

In prior art schemes, the back light module utilizes high power LEDs. If the luminance of an LED is divided into 17 (i.e. $4^2+1$) levels, the PWM controller 130 has to transmit a 4-bit control signal to control the LED. Thus, the data transmission quantity will increase when the LED has more luminance levels. In addition, there is a problem of overheating of the LEDs due to the LEDs usually emitting light for a long time. If one of the LEDs fails, it will result in the whole light source being of unstable quality.

SUMMARY OF THE INVENTION

It is therefore an objective of the present invention to provide a back light module utilizing a dithering scheme to drive a plurality of light emitting units and a driving method for driving a back light module to solve the abovementioned problem.

According to the present invention, a back light module is disclosed. The back light module includes a plurality of light emitting units and a driving unit. The driving unit is electrically connected to the light emitting units and utilized for driving the light emitting units according to a switched-on number of the light emitting units and a dithering scheme.

According to the present invention, a driving method for a back light module is further disclosed. The driving method includes: disposing a plurality of light emitting units in the back light module, and driving the light emitting units according to a switched-on number of the light emitting units and a dithering scheme.

These and other objectives of the present invention will become obvious to those people of average skill in the pertinent art after they read the following detailed description of the preferred embodiment that is illustrated in the various figures and drawings.

BRIEF DESCRIPTION OF THE DRAWINGS

FIG. 7 is a diagram of a switched-on sequence of the light emitting units under the dithering scheme by a 4×4 matrix.

FIG. 8 is a diagram of a switched-on sequence of the light emitting units under the dithering scheme by an 8×8 matrix.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "electrically connect" is intended to mean either an indirect or direct electrical connection. Accordingly, if one device is coupled to another device, that connection may be through a direct electrical connection, or through an indirect electrical connection via other devices and connections.

Figure 2:
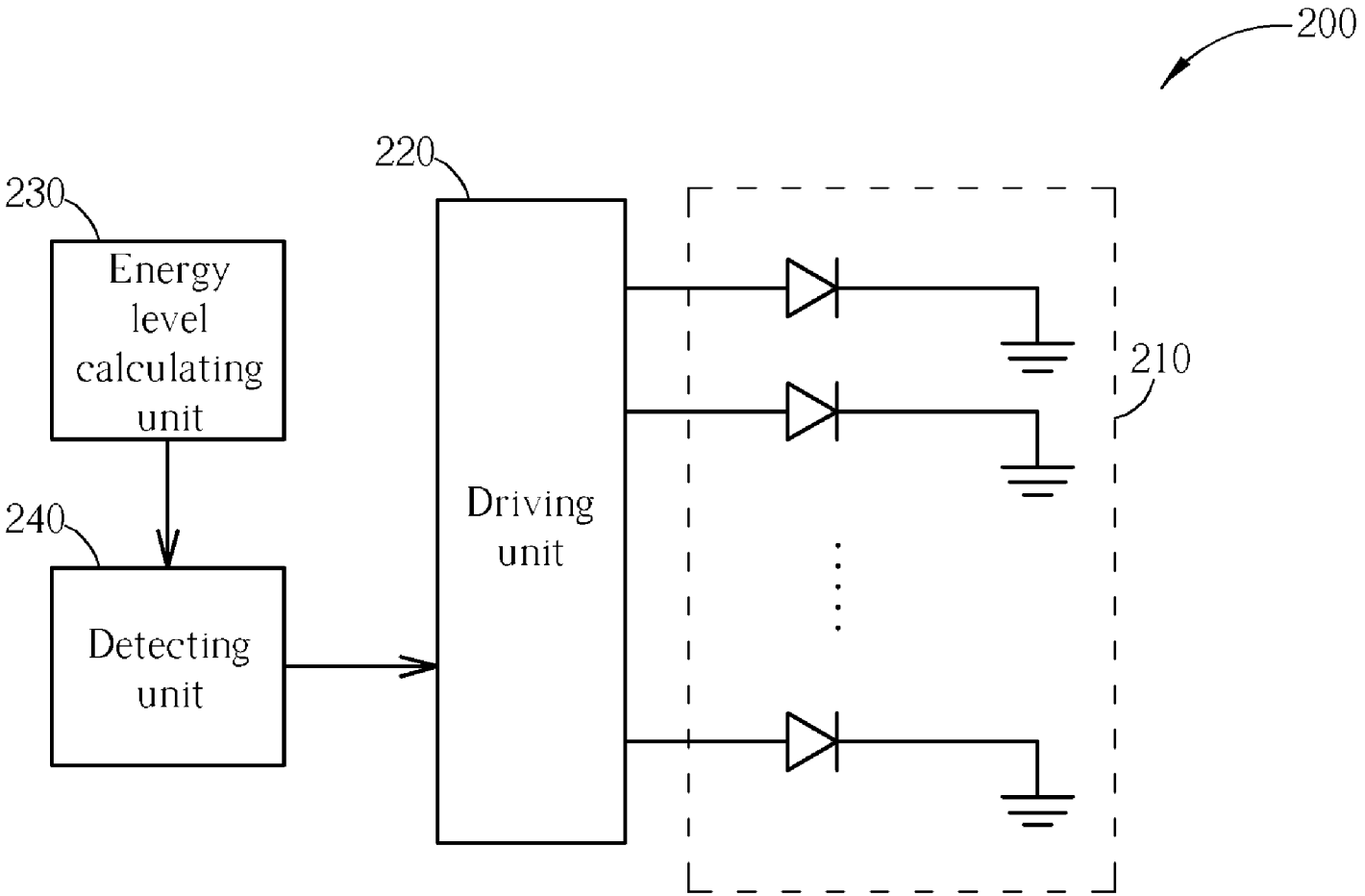
FIG. 2 is a diagram of a back light module according to an embodiment of the present invention.

Please refer to FIG. 2. FIG. 2 is a diagram of a back light module 200 according to an embodiment of the present invention. Please note that the present invention utilizes a back light module applied in a liquid crystal display (LCD) for illustration purposes, but the back light module disclosed by the present invention is not limited to the back light module of an LCD. That is, every light source that applies the driving scheme of the present invention falls within the scope of the present invention. In this embodiment, the back light module 200 includes a plurality of light emitting units 210 (such as light emitting diodes (LEDs)) and a driving unit 220. The driving unit 220 is electrically connected to the light emitting units 210 and utilized for driving the light emitting units 210 according to a switched-on number of the light emitting units 210 and a dithering scheme. Please note that the light emitting units 210 are utilized for providing a light source required by a plurality of pixels in a display area on a display panel of the LCD. As shown in FIG. 2, the back light module 200 further includes an energy level calculating unit 230 and a detecting unit 240, wherein the energy level calculating unit 230 is utilized for calculating an energy level corresponding to the display area, and the detecting unit 240 is electrically connected to the energy level calculating unit 230 and the driving unit 220, and utilized for determining the required switched-on number of the light emitting units 210 according to the energy level corresponding to the display area.

In this embodiment, the number of the light emitting units 210 is $4^n$, and an arrangement scheme of the light emitting units 210 is a $2^n \times 2^n$ matrix, wherein n is a positive integer. In addition, the energy level calculating unit 230 divides the possible energy levels into alternative $(4^n+1)$ energy levels. For example, when n is equal to 1, then the driving unit 220 has to drive 4 light emitting units respectively arranged in a 2×2 matrix, and the energy level calculating unit 230 determines an energy level from the alternative 5 energy levels as the energy level of the display area corresponding to the 4 light emitting units; when n is equal to 2, the driving unit 220 has to drive 16 light emitting units respectively arranged in a 4×4 matrix, and the energy level calculating unit 230 determines an energy level from the alternative 17 energy levels as the energy level of the display area corresponding to the 16 light emitting units. The above operation of determining the energy level of the display area is described in detail as follows: the energy level calculating unit 230 calculates a gray level mean value of the pixels in the display area, and determines the energy level corresponding to the display area from the alternative $(4^n+1)$ energy levels according to the gray level mean value. Please note that the operational principles and functions of the dithering scheme are well known to those of average skill in this art, and thus only one embodiment (taking n=1 as an example) is given for illustration in this document.

Figure 3:
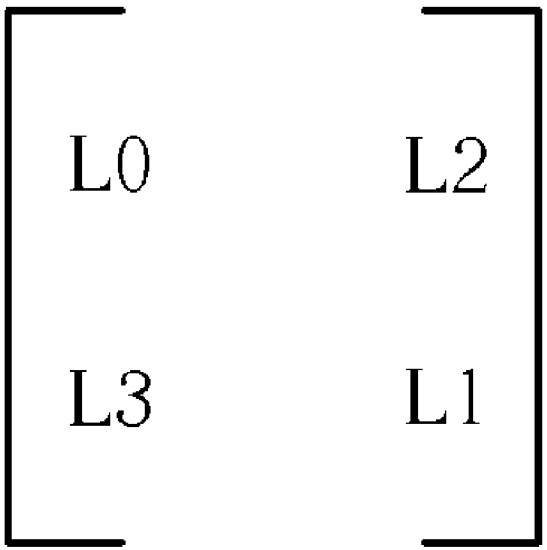
FIG. 3 is a diagram of a switched-on sequence of the light emitting units under the dithering scheme by a 2×2 matrix.

The present invention utilizes area control to divide the LCD panel and the LED back light into a plurality of areas, wherein each area of the LCD panel corresponding to each area of the LED back light, and each LED back light area includes a back light module 200. For example, if there are 128 light emitting units 210 in the whole LED back light area, then the LCD panel can be divided into 8×4 areas, and the back light module 200 corresponding to each area includes 4 light emitting units 210 arranged in a 2×2 matrix. Please refer to FIG. 3. FIG. 3 is a diagram of a switched-on sequence of the light emitting units 210 under the dithering scheme by a 2×2 matrix. As shown in FIG. 3, L0, L1, L2, and L3 are, respectively, the symbols of the 4 light emitting units 210. Since there are 4 light emitting units 210 in the LED back light area, the LED back light area is able to provide five possible energy level intervals (such as 0, 0 to 0.25, 0.25 to 0.5, 0.5 to 0.75, and 0.75 to 1).

Figure 4:
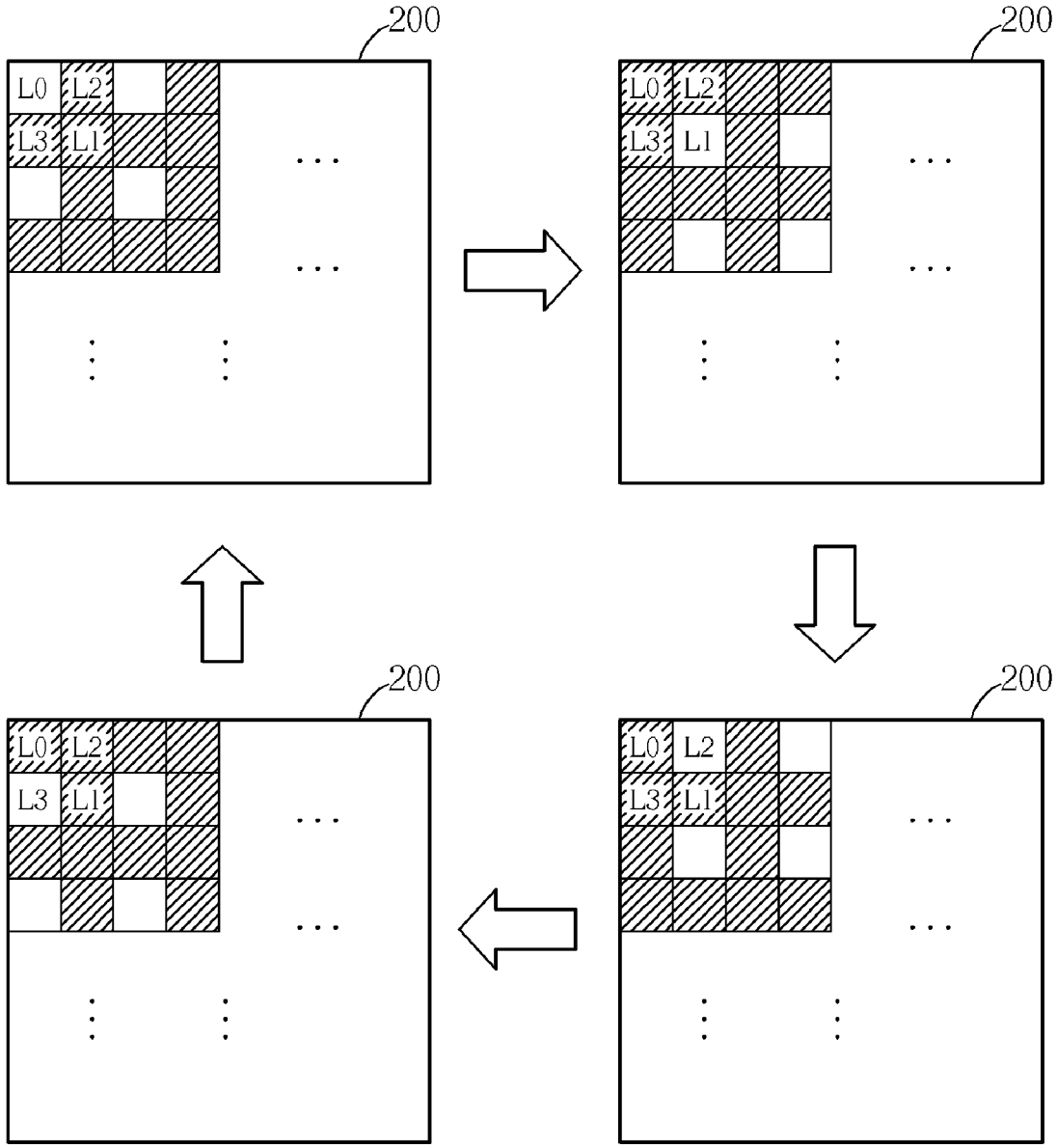
FIG. 4 is a diagram of the light emitting sequence of the back light module corresponding to each display area of the LCD panel switching on one light emitting unit at a time.
Figure 5:
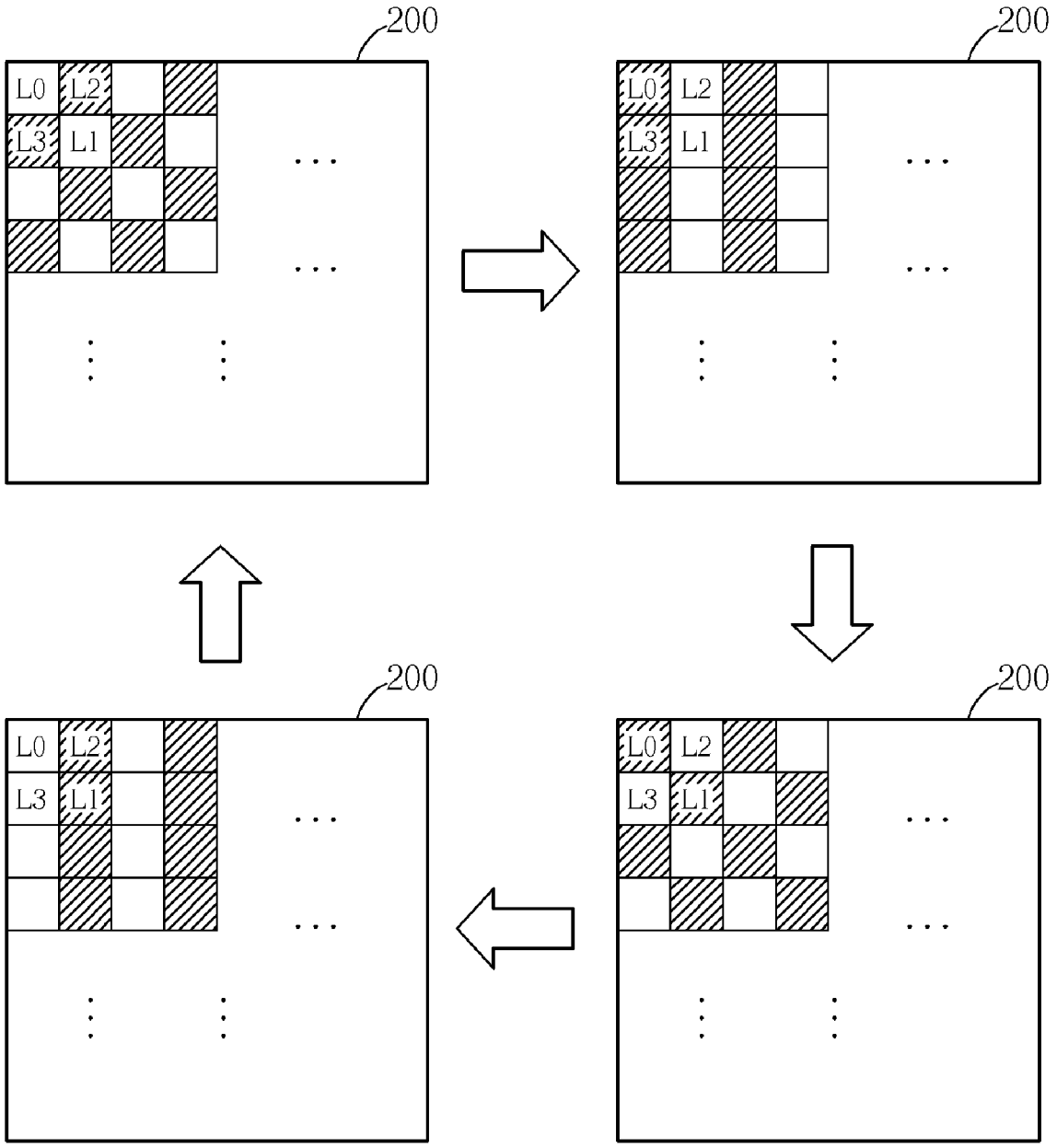
FIG. 5 is a diagram of the light emitting sequence of the back light module corresponding to each display area of the LCD panel switching on two light emitting units at a time.
Figure 6:
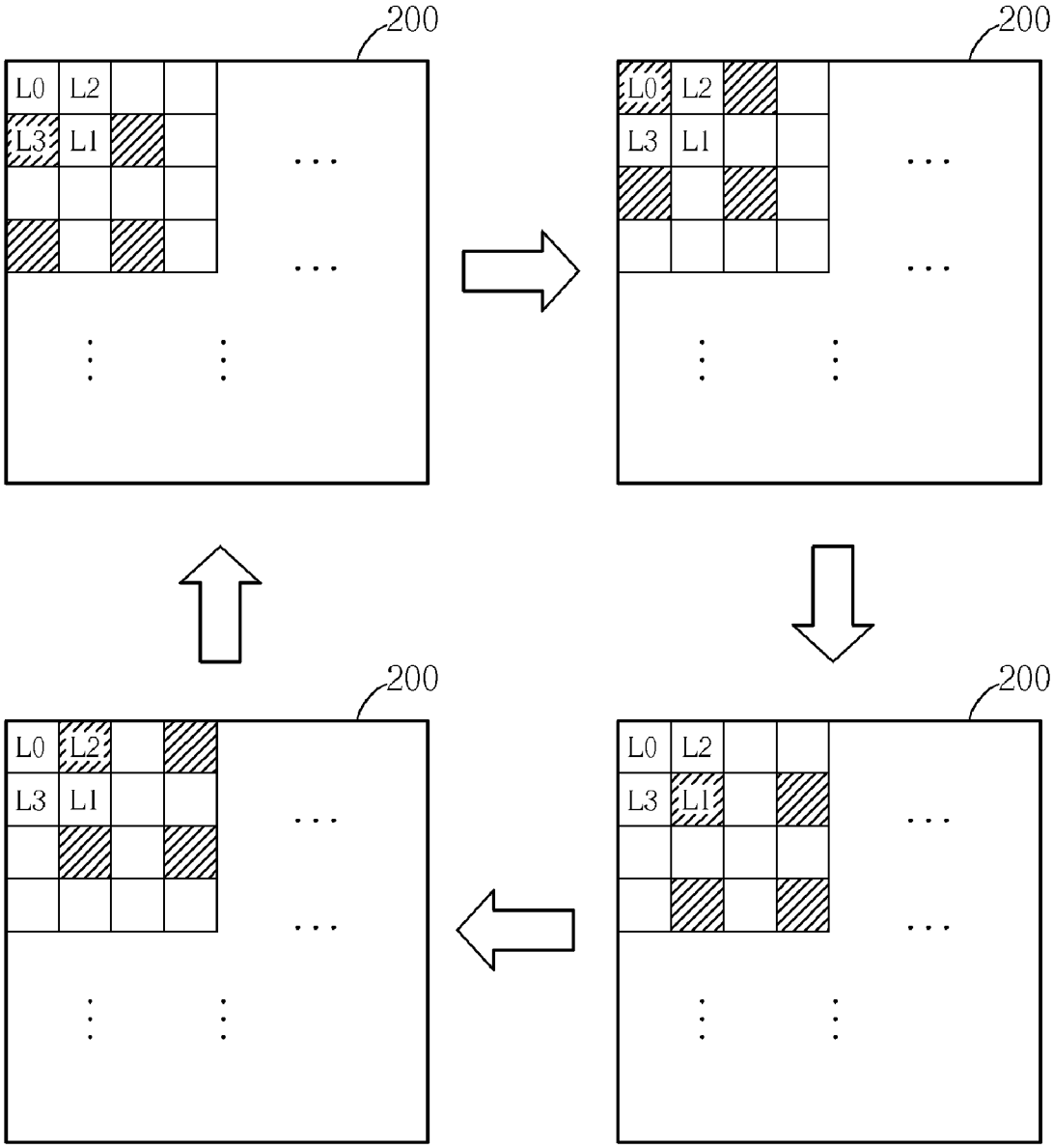
FIG. 6 is a diagram of the light emitting sequence of the back light module corresponding to each display area of the LCD panel switching on three light emitting units at a time.

In the beginning, the energy level calculating unit 230 will utilize gray level statistics to process the gray levels of a plurality of pixels in an LCD panel area, wherein the darkest gray level value is defined as 0, and the brightest gray level value is defined as 1. In this way, the gray level values will fall between 0 and 1, and then the energy level calculating unit 230 will calculate a gray level mean value of the pixels in the LCD panel area and determine the energy level corresponding to the LCD panel area from the alternative 5 energy levels according to the gray level mean value. If the energy level falls into the level 0 (i.e. 0), then the detecting unit 240 will determine that none of the 4 light emitting units 210 are switched on. If the energy level falls into the level 1 (i.e. 0 to 0.25), then the detecting unit 240 will determine that only one light emitting unit 210 in the 4 light emitting units 210 (i.e. L0, L1, L2, and L3) of the back light module 200 corresponding to each LCD panel area is switched on each time, and the driving unit 220 will control the light emitting sequence to circulate in a sequence of L0, L1, L2, L3, L0, L1, L2, L3, . . . the result is shown in FIG. 4. FIG. 4 is a diagram of the light emitting sequence of the back light module 200 corresponding to each display area of the LCD panel switching on one light emitting unit at a time, wherein the oblique line areas represent that the light emitting units are not switched on. If the energy level falls into the level 2 (i.e. 0.25 to 0.5), then the detecting unit 240 will determine that two light emitting units 210 in the 4 light emitting units 210 of the back light module 200 corresponding to each LCD panel area are switched on each time, and the driving unit 220 will control the light emitting sequence to circulate in a sequence of L0 and L1, L1 and L2, L2 and L3, L3 and L0, L0 and L1, L1 and L2, L2 and L3, L3 and L0, . . . ; the result is shown in FIG. 5. FIG. 5 is a diagram of the light emitting sequence of the back light module 200 corresponding to each display area of the LCD panel switching on two light emitting units at a time, wherein the oblique line areas represent that the light emitting units are not switched on. If the energy level falls into the level 3 (i.e. 0.5 to 0.75), the detecting unit 240 will determine that three light emitting units 210 in the 4 light emitting units 210 of the back light module 200 corresponding to each LCD panel area are switched on each time, and the driving unit 220 will control the light emitting sequence to circulate in a sequence of L0 and L1 and L2, L1 and L2 and L3, L2 and L3 and L0, L3 and L0 and L1, L0 and L1 and L2, L1 and L2 and L3, L2 and L3 and L0, L3 and L0 and L1, . . . ; the result is shown in FIG. 6. FIG. 6 is a diagram of the light emitting sequence of the back light module 200 corresponding to each display area of the LCD panel switching on three light emitting units at a time, wherein the oblique line areas represent that the light emitting units are not switched on. If the energy level falls into the level 4 (i.e. 0.75 to 1), then the detecting unit 240 will determine that four light emitting units 210 in the 4 light emitting units 210 of the back light module 200 corresponding to each LCD panel area are switched on simultaneously at a time, and the driving unit 220 will control all of the four light emitting units 210 to light. Please note that, when processing the display of a next frame, the calculating unit 230 will recalculate a new energy level corresponding to the next frame to update the current energy level setting, and the driving unit 220 will drive the light emitting units 210 according to the dithering scheme mentioned above.

Please note that the 4 light emitting units 210 arranged in the 2×2 matrix is the minimum unit utilized by the driving scheme of the present invention, and other numbers (such as 16, 64, etc.) of light emitting units are variations in the basis of the 2×2 matrix. For example, FIG. 7 is a diagram of a switched-on sequence of the light emitting units 210 under the dithering scheme by a 4×4 matrix, wherein L0 to L15 are respectively the symbols of the 16 light emitting units 210. FIG. 8 is a diagram of a switched-on sequence of the light emitting units 210 under the dithering scheme by an 8×8 matrix, wherein L0 to L63 are, respectively, the symbols of the 64 light emitting units 210. To those of average skill in this art, it is very easy to understand the light emitting sequence of different numbers of the light emitting units 210 under different energy level settings according to the above disclosure of the present invention, and thus further detailed explanation is omitted herein for the sake of brevity.

Please note that the calculation of the energy level in this embodiment utilizes a gray level mean value of the pixels in the LCD panel area. However, in another embodiment, the energy level calculating unit can also calculate a gray level peak value of the pixels in the LCD panel area. In addition, the energy level calculating unit can also calculate an energy level by a weighting method according to each gray level and different luminance. All of these variations fall within the scope of the present invention.

Please note that the delimitation of the energy levels in this embodiment is delimited by a linear scheme except for the level 0. However, this is only an embodiment of the present invention, and not a limitation of the present invention. Other delimitation schemes done according to the requirements of the practical operations all fall within the scope of the present invention.

Figure 1:
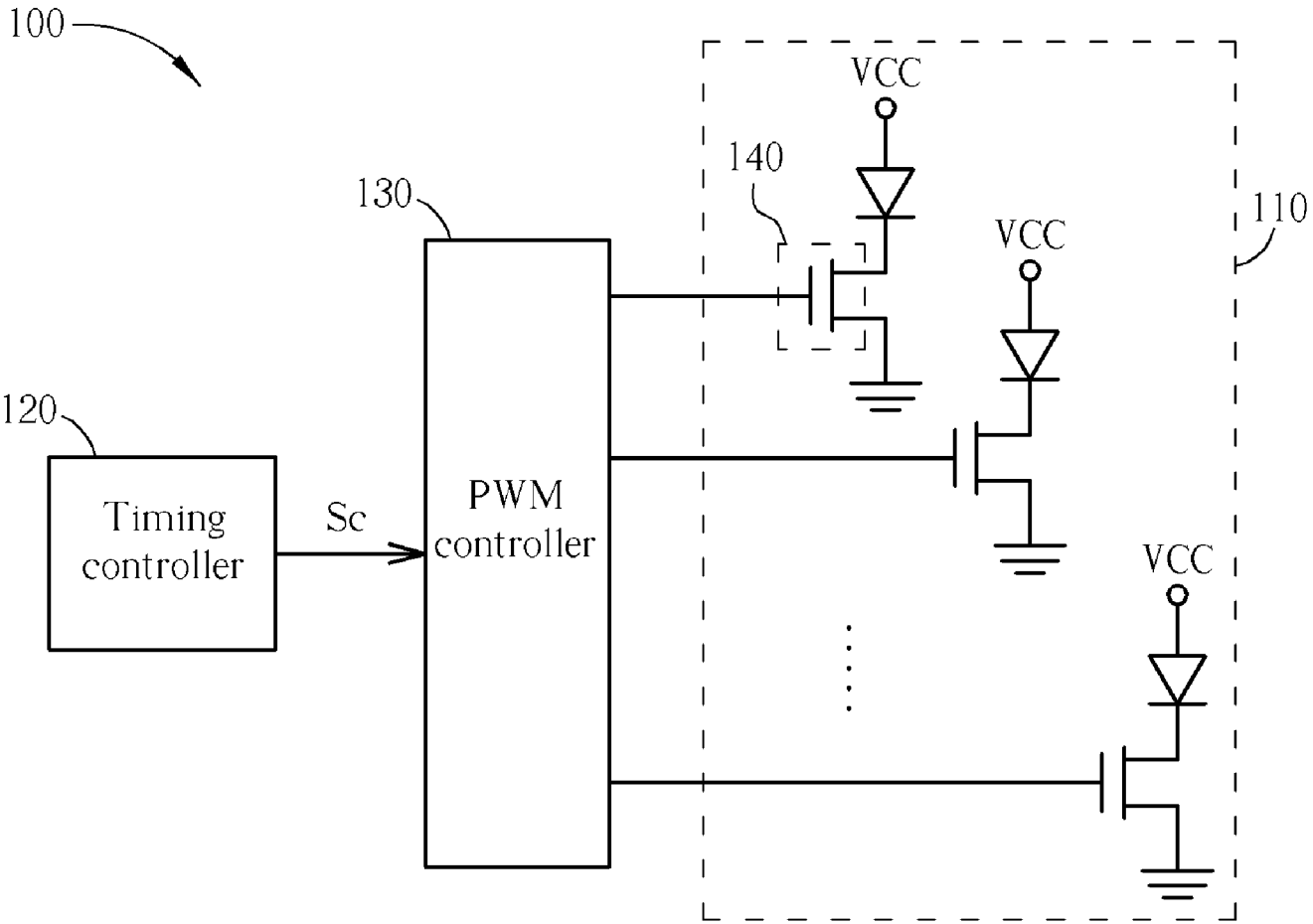
Fig. 1 Prior art
FIG. 1 is a diagram of a conventional back light module of a liquid crystal display (LCD).

In comparison with the prior art, each light emitting unit of the present invention utilizes a low power LED, which is configured to provide only two levels of luminance (i.e. there are only two options—"bright" and "dark"). In this way, the control signal of each LED only needs a single bit to be accomplished during the transmission no matter what kind of luminance variation is required, and thus the data transmission quantity will be reduced significantly. In other words, the control signal waiting time of the back light module will be reduced and the driving efficiency will be improved. In addition, the present invention does not have to use any integrated circuit (IC) having the function of pulse width modulation (PWM) (such as the PWM controller 130 shown in FIG. 1), and thus the complexity of the control scheme can be reduced substantially. The present invention utilizes a low power LED, and therefore the cost can be reduced significantly. In addition, the present invention utilizes the dithering scheme for driving the LED so the LED does not always need to be switched on, and instead has a proper switch-off time. Therefore, the problem of overheating for an LED is solved.

Those skilled in the art will readily observe that numerous modifications and alterations of the device and method may be made while retaining the teachings of the invention.

What is claimed is:

1. A back light module, comprising:

a plurality of light emitting units, for providing a light source required by a plurality of pixels in a display area;

an energy level calculating unit, for calculating an energy level corresponding to the display area;

a detecting unit, electrically connected to the energy level calculating unit, for determining a switched-on number of the light emitting units according to the energy level corresponding to the display area; and a driving unit, electrically connected to the light emitting units and the detecting unit, for driving the light emitting units according to the switched-on number of the light emitting units and a dithering scheme wherein a number of the light emitting units is $4^n$, the light emitting units are arranged in a $2^n \times 2^n$ matrix, and n is a positive integer; wherein the energy level calculating unit determines the energy level corresponding to the display area from alternative $(4^n+1)$ energy levels; wherein the energy level calculating unit calculates a gray level mean value of the pixels in the display area, and determines the energy level corresponding to the display area from the alternative $(4^n+1)$ energy levels according to the gray level mean value; wherein the energy level calculating unit calculates a gray level peak value of the pixels in the display area, and determines the energy level corresponding to the display area from the alternative $(4^n+1)$ energy levels according to the gray level peak value.

2. The back light module of claim 1, wherein each of the light emitting units comprises a light emitting diode (LED).

3. The back light module of claim 1, wherein each of the light emitting units is configured to provide two levels of luminance.

4. A driving method for a back light module, comprising:

disposing a plurality of light emitting units in the back light module, wherein the light emitting units are utilized for providing a light source required by a plurality of pixels in a display area;

calculating the energy level corresponding to the display area;

determining a switched-on number of the light emitting units according to the energy level corresponding to the display area; and driving the light emitting units according to the switched-on number of the light emitting units and a dithering scheme wherein a number of the light emitting units is $4^n$, the light emitting units are arranged in a $2^n \times 2^n$ matrix, and n is a positive integer; wherein the energy level calculating unit determines the energy level corresponding to the display area from alternative $(4^n+1)$ energy levels; wherein the energy level calculating unit calculates a gray level mean value of the pixels in the display area, and determines the energy level corresponding to the display area from the alternative $(4^n+1)$ energy levels according to the gray level mean value; wherein the energy level calculating unit calculates a gray level peak value of the pixels in the display area, and determines the energy level corresponding to the display area from the alternative $(4^n+1)$ energy levels according to the gray level peak value.

5. The driving method of claim 4, wherein each of the light emitting units comprises an LED.

6. The driving method of claim 4, wherein each of the light emitting units is configured to provide two levels of luminance.

* * * * *